United States Patent [19]

Heger et al.

[11] 4,078,518

[45] Mar. 14, 1978

[54] ARRANGEMENT FOR THE TREATMENT OF HIGH-POLYMER ARTICLES WITH BOILING ACRYLIC ACID

[75] Inventors: Adolf Heger; Bernd Ihme, both of Dresden; Johannes Morgenstern, Pirna-Copitz; Güenther Müeller; Helmar Paessler, both of Dresden, all of Germany

[73] Assignee: Veb Textilkombinat Cottbus, Cottbus, Germany

[21] Appl. No.: 549,073

[22] Filed: Feb. 11, 1975

[51] Int. Cl.[2] ..... B05C 3/132

[52] U.S. Cl. ..... 118/419; 118/423; 118/429; 427/434 R

[58] Field of Search ..... 118/429, 419, 420, 423, 118/424, 68, 67; 68/232; 204/52 R, 275, 181; 137/1; 450/632; 427/434

[56] References Cited

U.S. PATENT DOCUMENTS

| | | | |
|---|---|---|---|
| 2,794,658 | 6/1957 | Purkhiser | 285/173 X |
| 2,834,993 | 5/1958 | Dipner | 118/67 X |
| 2,960,963 | 11/1960 | Shelton | 118/423 X |
| 3,282,249 | 11/1966 | Ramsay | 118/405 X |
| 3,547,788 | 12/1970 | Tanaka et al. | 204/181 X |
| 3,679,564 | 7/1972 | Dowbenko et al. | 204/181 X |
| 3,697,467 | 10/1972 | Haughney | 204/181 X |
| 3,846,269 | 11/1974 | Martello et al. | 204/181 |
| 3,881,036 | 4/1975 | Brown | 118/420 X |

FOREIGN PATENT DOCUMENTS

| | | | |
|---|---|---|---|
| 224,756 | 11/1957 | Australia | 450/632 |
| 841,638 | 7/1960 | United Kingdom | 450/632 |

*Primary Examiner*—Mervin Stein
*Attorney, Agent, or Firm*—Michael J. Striker

[57] ABSTRACT

An arrangement for the treatment of high-polymer articles with boiling acrylic acid or solutions thereof, particulary for use in the grafting of acrylic acid to previously irradiated high-polymer articles such as textiles and the like, has a vessel for accommodating an acrylic acid-containing bath. The arrangement further comprises at least one member which is provided with a copper surface, and the member is arranged in such a fashion that the copper surface is exposed to the interior of the vessel. The copper surface is free of direct contact with all metallic parts of the arrangement having a substantially different composition than this surface and, advantageously, this is effected by electrically insulating the copper surface or the member from the remainder of the arrangement. The insulation of the copper surface or the member from the metallic parts of the arrangement prevents corrosion effects which might occur by virtue of contact between dissimilar metals. The purpose of the copper surface is to prevent the build-up of acrylic acid homopolymer in the arrangement so that frequent disassembly of the arrangement for cleaning may be avoided. The copper surface may be arranged in the bath or exteriorly of the bath. In the latter event, the copper surface serves as a condensation surface for acrylic acid.

12 Claims, 4 Drawing Figures

FIG. 1
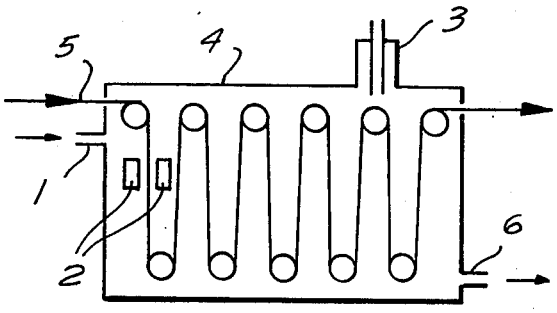
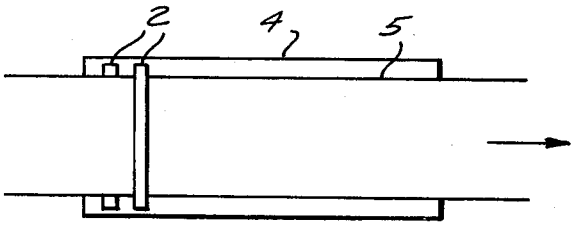
FIG. 2
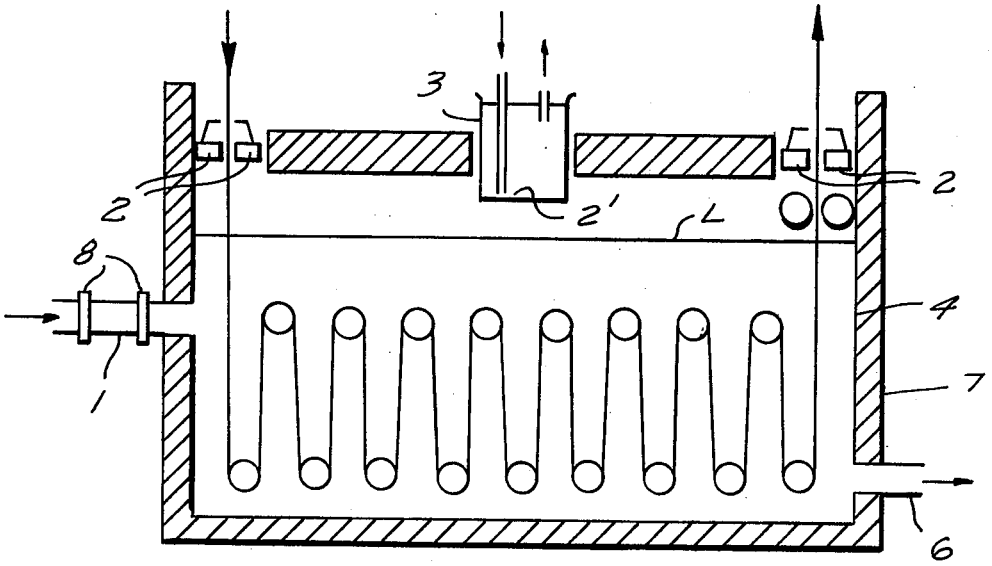
FIG. 3

ARRANGEMENT FOR THE TREATMENT OF HIGH-POLYMER ARTICLES WITH BOILING ACRYLIC ACID

BACKGROUND OF THE INVENTION

The invention relates to an arrangement for the treatment of high-polymer articles with boiling acrylic acid and solutions thereof. Of particular interest to the invention is an arrangement for the grafting of acrylic acid to high-polymer articles, especially textile articles which contain polyester or polyamide fibers, which have been previously irradiated with ionizing radiation.

It is known to subject high-polymer articles such as, for instance, webs, to irradiation with a view towards modifying their properties. The radiation used is an ionizing radiation in that it causes the formation of ions or the like in the high-polymer material.

A modification of the properties of the thus-irradiated (pre-irradiated) articles, particularly articles made of polyester fibers, is obtained by grafting the pre-irradiated articles with acrylic acid. This may be accomplished by treating the articles with diluted, aqueous acrylic acid at a temperature of about 100° C for some period of time (of the order of 30 minutes). During the treatment, evaporation of the acrylic acid occurs and the evaporated acrylic acid must be condensed in the grafting apparatus. As a result, a strong build-up of acrylic acid homopolymer occurs at the liquid-gas interfaces of the apparatus. This, in turn, makes it necessary to frequently disassemble such an apparatus in order to permit mechanical removal of the homopolymer.

Attempts to overcome this problem have involved the use of stabilizers and, in particular, the industrially used stabilizer hydrochinone monomethylether. It has, however, been demonstrated that this stabilizer does not sufficiently suppress the homopolymer formation in boiling, aqueous acrylic acid.

It is also known that copper is a stabilizer for acrylic acid, that is, that copper reduces the homopolymer formation.

There is, however, no apparatus known wherein the formation of acrylic acid homopolymer from boiling acrylic acid and its solutions can be satisfactorily suppressed.

SUMMARY OF THE INVENTION

It is, accordingly, an object of the invention to eliminate, or at least substantially reduce the frequency of, the disassembly of the grafting apparatus, as well as the mechanical removal of the homopolymer, required in the prior art apparatus.

Another object of the invention is to provide an effective manner of suppressing the formation of homopolymers from acrylic acid and its solutions.

A further object of the invention is to provide a novel arrangement for the treatment of articles with acrylic acid-containing media.

An additional object of the invention is to provide an arrangement for the treatment of articles with acrylic acid-containing media which, at most, need be disassembled and mechanically cleaned only infrequently.

These objects, and others which will become apparent hereinafter, are achieved in accordance with the invention. According to one aspect of the invention, there is provided, in an arrangement for the treatment of articles with acrylic acid or solutions thereof, particularly for use in the grafting of acrylic acid to pre-irradiated high-polymer articles with boiling acrylic acid or solutions thereof, a combination comprising a vessel for accommodating an acrylic acid-containing bath. The arrangement further comprises at least one member which includes a surface portion containing metallic copper arranged so that the surface portion is exposed to the interior of the vessel. The surface portion is free of direct contact with the metallic parts of the arrangement having a composition substantially different from the composition of the surface portion itself.

As has already been indicated, of particular interest to the invention is an arrangement for the grafting of pre-irradiated high-polymer articles such as, for instance, webs, with boiling acrylic acid or its solutions. Examples of high-polymer articles which are of special concern to the invention include textile webs which contain or consist of polyester or polyamide fibers.

The copper-containing surface portion may be arranged such that, when an acrylic acid-containing bath is provided in the vessel, it is located in the bath. On the other hand, it is also possible for this surface portion to be arranged exteriorly of the bath accommodated in the vessel and, in such an event, the surface portion may constitute a condensation surface for the acrylic acid of the bath. It is further possible to have more than one member which is provided with a copper-containing surface portion free of direct contact with the metallic parts of the arrangement having a composition substantially different from that of the respective surface portion and to have one or more of these surface portions arranged in the bath and one or more of these surface portions arranged exteriorly of the bath.

The arrangement may include means for conveying an article, for instance, an elongated article such as a web or the like, through the vessel along a predetermined path. It is of advantage here when a copper-containing surface portion is arranged so as to extend over the width of the path or, in other words, over the entire width of the article being conveyed through the vessel. It is particularly favorable in such a case for the surface portion to extend across the width of the path in such a manner that it extends substantially normal to the path, that is, to the direction of travel of the article along the path.

The member on which the copper-containing surface portion is provided may be in the form of a bar or in the form of a grid. The member, as well as the surface portion thereof, may be composed predominantly of or may consist essentially of metallic copper. It is then favorable for the member itself to be free of direct contact with the metallic parts of the arrangement having a composition substantially different therefrom.

The vessel may be provided with an inlet conduit for the introduction of the acrylic acid-containing bath therein. It is advantageous here for the inlet conduit, or at least a portion thereof, to be composed predominantly of or to consist essentially of metallic copper. The vessel may also be provided with an outlet conduit for the withdrawal of the acrylic acid-containing bath therefrom. It is also advantageous for this outlet conduit, or at least a portion thereof, to be composed predominantly of or to consist essentially of metallic copper.

In accordance with the invention, insulating members may be provided to prevent direct contact between the copper-containing member or surface portion and the metallic parts of the arrangement having a composition substantially different therefrom. Advantageously, the copper-containing member or surface portion is electrically insulated from such metallic parts of the arrangement. Examples of suitable materials which may be used for insulating the copper-containing member or surface portion from the metallic parts of the arrangement having a composition substantially different therefrom include ceramics, e.g. glazed or vitrified porcelain, Teflon (trademark), etc.

The purpose of avoiding direct contact between the copper-containing member or surface portion and the metallic parts of the arrangement having a composition substantially different from that of the member or surface portion is to prevent the contact corrosion which occurs when dissimilar metals directly contact one another. For instance, the vessel which accommodates the acrylic acid-containing bath, and/or other components of the arrangement, may be composed of an iron-base metal. Thus, if a member or surface portion composed at least predominantly of metallic copper were to directly contact such iron-base parts of the arrangements, undesirable contact corrosion effects may arise. According to one embodiment of the invention, this may be avoided by interposing an insulating member between the copper-containing member or surface portion and the iron-base part of the arrangement.

It may be seen that, in accordance with one aspect of the invention, the objects outlined previously are achieved by the provision of acrylic acid condensation surfaces of metallic copper which are electrically insulated with respect to the remainder of the arrangement and/or by the provision of metallic copper in the vessel for the acrylic acid-containing bath which is electrically insulated with respect to the vessel or vessel housing. It is favorable, although not necessary, for the metallic copper to be bar-shaped or grid-shaped and for the metallic copper to extend across the entire article, for instance, a textile web, being treated. It is further favorable when the metallic copper extends in a direction normal to the article, e.g. a textile web, being treated. As mentioned earlier, it is also of advantage to provide inlet and outlet conduits for the acrylic acid-containing medium which are at least partially composed of metallic copper.

The presence of metallic copper in the acrylic acid-containing bath, which latter may be a grafting bath, effectively suppresses homopolymer formation. The copper condensation surfaces, which may be of small dimensions, serve the same purpose.

In accordance with the invention, a large surface area for condensation is advantageously avoided. This may be accomplished by surrounding the vessel for the acrylic acid-containing bath on all sides with a heating jacket. According to this embodiment of the invention, condensation should occur only in small regions, that is, the surface area available for condensation should be kept small, and these regions should be entirely or partially composed of copper.

The novel features which are considered as characteristic of the invention are set forth in particular in the appended claims. The invention itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic representation of one form of an arrangement according to the invention;

FIG. 2 is a top view of the arrangement of FIG. 1;

FIG. 3 is a schematic representation in section of another form of arrangement according to the invention.

DESCRIPTION OF THE PREFERRED EMBODIMENTS

Figure 4:
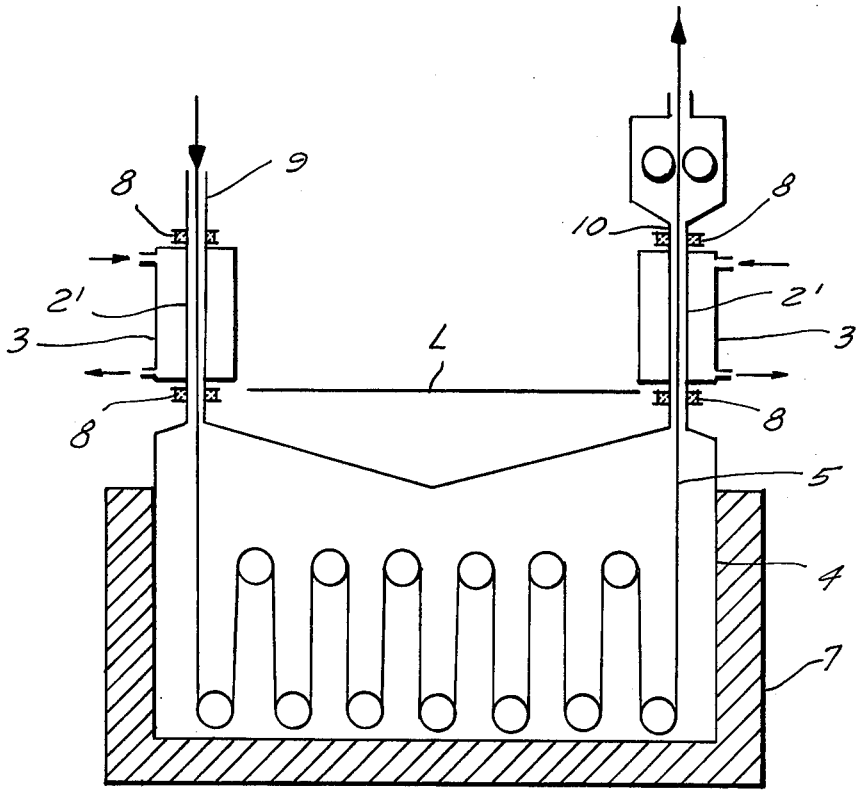
FIG. 4 is a schematic representation in section of yet another form of arrangement according to the invention.

Referring first to FIGS. 1 and 2, it may be seen that the arrangement illustrated therein includes a vessel 4 for accommodating an acrylic acid-containing bath. The vessel 4 is provided with an inlet conduit 1 for the introduction of the acrylic acid-containing bath therein and with an outlet conduit 6 for withdrawing the acrylic acid-containing bath therefrom. The vessel 4 is here shown as also being provided with a cooler 3 for cooling purposes.

As best seen in FIG. 1, a conveying arrangement is provided in the vessel 4 and, in the illustrated embodiment, is shown as being in the form of a pulley or roller arrangement. The conveying arrangement enables a web or band 5 of material to be passed through the vessel 4 so that the web 5 may come into contact with the acrylic acid-containing bath in the vessel 4. The direction of travel of the web 5 through the vessel 4 is indicated by the arrows and the web 5 may be continuously conveyed through the vessel 4 by the conveying arrangement. The web 5 may, for instance, contain or be composed of a high-polymer or textile material and the web 5 may have been irradiated with ionizing radiation, that is, radiation which causes the formation of ions or the like in the web 5, prior to entering the vessel 4. In such an event, grafting of the acrylic acid in the acrylic acid-containing bath to the irradiated portions of the web 5 may occur in the vessel 4.

In accordance with the invention, the interior of the vessel 4 is exposed to metallic copper for the purpose of reducing acrylic acid homopolymer formation and, in the illustrated embodiment, the metallic copper is in the form of bars 2. The bars 2 are here arranged in such a manner that they are located in the acrylic acid-containing bath accommodated in the vessel 4. As most clearly seen in FIG. 2, the bars 2 extend across the entire width of the web 5 which is being conveyed through the vessel 4, that is, the bars 2 extend across the entire width of the path of travel of the web 5 through the vessel 4. It may also be seen that the bars 2 extend in a direction which is normal to the direction of travel of the web 5 through the vessel 4 or, in other words, that in the present case the bars 2 are elongated with the direction of elongation thereof being normal to the direction of travel of the web 5 through the vessel 4. Although the metallic copper has here been illustrated as being in the form of bars, the metallic copper could also be in the form of a grid which extends across the entire width of the web 5 and extends normal to the direction of travel of the web 5 through the vessel 4.

In the event that the walls of the vessel 4 are composed of a material, e.g. an iron-base metal having a composition substantially different from that of the bars 2, the latter are, according to the invention, advantageously free of direct contact with the walls of the vessel 4. This avoids the corrosion effects which arise when dissimilar metals are placed in contact with one another, particularly in the presence of an electrolyte. Direct contact between the bars 2 and the vessel 4 may be prevented in any suitable manner.

Coming now to the embodiment of FIG. 3, it is pointed out that the same reference numerals as in FIGS. 1 and 2 have been used to designate similar components. The embodiment of FIG. 3 illustrates one manner in which condensation surfaces of small dimensions, that is, a small surface area for condensation, may be obtained.

In this instance, the vessel 4 which accommodates the acrylic acid-containing bath is surrounded on all sides thereof with a heating jacket 7. The heating jacket 7 enables the walls of the vessel 4 to be maintained at a temperature which is sufficiently high so that condensation cannot occur on the walls of the vessel 4.

It will be seen that the interior of the vessel 4 is again exposed to metallic copper but that, in the present case, the metallic copper is in the form of members 2 which are arranged exteriorly of the acrylic acid-containing bath accommodated in the vessel 4. The level of the bath is indicated at L. In addition to the metallic copper which is present in the form of the members 2, the surface 2' of the cooler 3 which is exposed to the acrylic acid-containing bath accommodated in the vessel 4 may also be composed of metallic copper. By virtue of the heating jacket 7, condensation occurs only at the surfaces of the members 2 and at the surface 2' of the cooler 3. Thus, by utilizing the embodiment of FIG. 3, it is possible to avoid a large surface area for condensation.

It is assumed here that the walls of the vessel 4, and other components of the arrangement, are composed of material such as, for instance, an iron-base metal, having a composition substantially different from that of the members 2 and the surface 2' of the cooler 3. Hence, according to the invention, the members 2 are free of direct contact with the walls of the vessel 4 and these other components of the arrangement and, in the present case, are electrically isolated therefrom. Similarly, the cooler 3, or at least the surface 2' thereof, is free of direct contact with the walls of the vessel 4 and the other components of the arrangement which are of a substantially different composition than the surface 2'.

In the illustrated embodiment, a portion of the inlet conduit 1 through which the acrylic acid-containing bath is admitted into the vessel 4 is also composed of metallic copper. In order to prevent direct contact between the copper portion of the inlet conduit 1 and the other portions thereof (which are here assumed to be composed of a material having a substantially different composition from that of the copper portion of the conduit 1) insulating members 8 are provided in the inlet conduit 1. Thus, it is that portion of the inlet conduit 1 arranged between the insulating members 8 which is here composed of metallic copper. The insulating members 8 may be composed of a material which electrically insulates the copper portion of the inlet conduit 1 from the adjacent portions thereof. Examples of suitable materials which may be used for the insulating members 8 include glazed or vitrified porcelain, Teflon (trademark), etc. Although only the inlet conduit 1 has here been illustrated as being at least partially composed of metallic copper, it is, of course, possible for the outlet conduit 6 also to be at least partially composed of metallic copper or, on the other hand, for only the outlet conduit 6, and not the inlet conduit 1, to be at least partially composed of metallic copper. It will be appreciated that, in the event the outlet conduit 6 is at least partially composed of metallic copper, direct contact between the outlet conduit 6, or the copper portion thereof, and metallic parts of the arrangement having a substantially different composition is advantageously avoided.

Referring now to the embodiment of FIG. 4, it is again pointed out that the same reference numerals as in the preceding FIGURES have been used to designate similar components. FIG. 4 illustrates a manner in which a large condensation surface in the vessel 4 may be avoided.

It may be seen that the web 5 which is to be treated with acrylic acid, e.g. for the purpose of grafting acrylic acid thereto, here enters the vessel 4 via conduit 9 and leaves the vessel 4 via a conduit 10. It may be mentioned that it is possible for the conduit 9 to serve as an inlet conduit for the introduction of the acrylic acid-containing bath into the vessel 4 and that it is possible for the conduit 10 to serve as an outlet conduit for the withdrawal of the acrylic acid-containing bath from the vessel 4. The conduit 9 is partially defined by the inner surface 2' of a cooler 3 whereas the conduit 10 is partially defined by the inner surface 2' of another cooler 3. The coolers 3 are here assumed to be composed of copper while the portions of the conduits 9 and 10 on either side of the respective coolers 3 are assumed to be composed of a material having a substantially different composition. Thus, in order to prevent direct contact between the coolers 3 and the other portions of the respective conduits 9 and 10, an insulating member 8 is provided on either side of each of the coolers 3. Again, the insulating members 8 may be composed of a material which electrically insulates the coolers 3 with respect to the adjacent portions of the respective conduits 9 and 10.

In order to avoid a large condensation surface, the minimum level L of the acrylic acid-containing bath is here selected in such a manner that the bath level L lies above the top of the vessel 4, that is, the acrylic acid-containing bath actually rises into the conduits 9 and 10. In this manner, the vessel 4 is entirely filled with the bath so that substantially no condensation can occur in the vessel 4. It may be seen that, as a result, condensation can occur only in the conduits 9 and 10 and, in particular, by maintaining the level L of the bath as shown, only on the inner surfaces 2' of the coolers 3.

The following Examples are intended to illustrate one mode of applicability of an arrangement according to the invention but are not intended to limit the invention in any manner:

EXAMPLE 1

A polyester silk fabric of large circular knit having a mass per unit area of 150 grams per square meter is passed below the scanner of an electron accelerator where it is continuously irradiated with accelerated electrons. The electron energy is 0.5 MeV and the radiation dose achieved is 30 Mrad. This irradiation is an ionizing irradiation. The thus-treated fabric is continuously conveyed through an arrangement such as illustrated in FIGS. 1 and 2. The vessel 4 of the arrangement contains a 25 percent aqueous solution of acrylic acid which is stabilized with 200 parts per million of hydrochinone monoethylether (the acrylic acid used for the Example is delivered by the manufacturer with hydrochinone monoethylether as a stabilizer). The temperature of the solution is 100° C and the dwell time of the fabric in the solution is 1 hour. During the passage of the fabric through the solution, acrylic acid grafts onto the fabric. After passing through the solution, the fabric is thoroughly rinsed out with cold water. An increase in mass of approximately 10 percent is obtained.

EXAMPLE 2

A flat warp-knitted polyamide silk fabric having a mass per unit area of 150 grams per square meter is irradiated with accelerated electrons (ionizing irradiation). The electron energy is 0.5 MeV and the radiation dose achieved is 8 Mrad. Thereafter, the fabric is conveyed through an arrangement such as illustrated in FIG. 2 or FIG. 3. The vessel 4 of the arrangement contains a 15 percent aqueous solution of acrylic acid which is stabilized with 200 parts per million of hydrochinone monoethylether (the acrylic acid used for the Example is delivered by the manufacturer with hydrochinone monoethylether as a stabilizer). The fabric is treated with the solution at temperatures between 40° and 100° C for a period of 2 minutes. Grafting of acrylic acid to the fabric occurs during the treatment. Subsequent to the treatment, the fabric is rinsed with cold water. An increase in mass of about 20 percent is obtained.

It has been indicated in the preceding description that the copper-containing member or surface portion provided in accordance with the invention is free of direct contact with metallic parts of the arrangement having a composition "substantially different from that" of the member or surface portion. A "substantially different composition" will be understood herein as meaning a difference in composition such that corrosion effects could arise as a result of dissimilar metal contact.

It will be understood that each of the elements described above, or two or more together, may also find a useful application in other types of arrangements differing from the types described above.

While the invention has been illustrated and described as embodied in a novel arrangement for the treatment of articles with acrylic acid or solutions thereof, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An arrangement for the treatment of articles with acrylic acid or solutions thereof, particularly for use in the grafting of acrylic acid to pre-irradiated high-polymer articles with boiling acrylic acid or solutions thereof, said arrangement comprising a vessel for accommodating an acrylic acid-containing bath; an acrylic acid-containing bath in said vessel; and at least one member which includes a surface portion of metallic copper arranged so that said surface portion is exposed to the interior of said vessel, said surface portion being free of direct contact with metallic parts of said arrangement having a composition substantially different from that of said surface portion, and said surface portion restricting the formation of acrylic acid homopolymer in said vessel, wherein said surface portion ia arranged exteriorly of said bath and constitutes a condensation surface for the acrylic acid of said bath.

2. An arrangement as defined in claim 1, wherein each condensation surface for acrylic acid consists essentially of metallic copper.

3. An arrangement for the treatment of articles with acrylic acid or solutions thereof, particularly for use in the grafting of acrylic acid to pre-irradiated high-polymer articles with boiling acrylic acid or solutions thereof, said arrangement comprising a vessel for accommodating an acrylic acid-containing bath; at least one member which includes a surface portion of metallic copper arranged so that said surface portion is exposed to the interior of said vessel, said surface portion being free of direct contact with metallic parts of said arrangement having a composition substantially different from that of said surface portion, and said surface portion restricting the formation of acrylic acid homopolymer in said vessel; an acrylic acid-containing bath in said vessel; and another member which includes another surface portion of metallic copper, said other member being arranged so that said other surface portion is exposed to the interior of said vessel, and said other surface portion also being free of direct contact with said metallic parts of said arrangement, one of said surface portions being arranged in said bath and the other of said surface portions being arranged exteriorly of said bath.

4. An arrangement for forming a graft polymer having a pre-irradiated high polymer as its main backbone chain, particularly for use in the grafting of boiling acrylic acid monomers or solutions thereof to high polymer materials such as polyester or polyamide fiber, comprising in combination, a vessel for accommodating a bath containing monomers of acrylic acid; a bath of boiling acrylic acid monomer in said vessel; a feeding means located exteriorly of said vessel; a pre-irradiated high polymer article introduced within the bath by said feeding means; and inhibiting means operative for preventing the homopolymerization of acrylic acid monomers but not preventing the formation of a graft polymer having the high polymer article as its main backbone and having side chains containing acrylic acid groups, said inhibiting means comprising a metallic copper-containing surface portion exposed to the bath, said surface portion being free of direct contact with metallic parts of said arrangement having a composition substantially different from that of said surface portion.

5. An arrangement as defined in claim 4, and wherein said surface portion is arranged in said bath.

6. An arrangement as defined in claim 4, comprising means for conveying an article through said vessel along a predetermined path; and wherein said surface portion is arranged so as to extend over the width of said path.

7. An arrangement as defined in claim 6, said surface portion being elongated; and wherein the direction of elongation of said surface portion is substantially normal to the direction of travel of said article along said path.

8. An arrangement as defined in claim 4, wherein said inhibiting means comprises a bar provided with said surface portion.

9. An arrangement as defined in claim 4 wherein said inhibiting means comprises a grid provided with said surface portion.

10. An arrangement as defined in claim 4, comprising an inlet conduit for the introduction of the acrylic acid-containing bath into said vessel, at least a portion of said inlet conduit being composed of metallic copper.

11. An arrangement as defined in claim 4, comprising an outlet conduit for the withdrawal of the acrylic acid-containing bath from said vessel, at least a portion of said outlet conduit being composed of metallic copper.

12. An arrangement as defined in claim 4, wherein said surface portion is at least predominantly composed of metallic copper and is free of direct contact with said substantially different metallic parts of said arrangement.

* * * * *